US005307720A

United States Patent [19]

Meyer et al.

[11] Patent Number: 5,307,720

[45] Date of Patent: May 3, 1994

[54] PUNCH RETAINER WITH PUNCH RELEASE TOOL

[75] Inventors: David G. Meyer, Centerville; Robert L. Shadowens, West Carrollton, both of Ohio

[73] Assignee: Dayton Progress Corporation, Dayton, Ohio

[21] Appl. No.: 115,601

[22] Filed: Sep. 3, 1993

[51] Int. Cl.[5] ..... B26F 1/14

[52] U.S. Cl. ..... 83/698.11; 83/686

[58] Field of Search ..... 83/698, 684, 686; 279/30

[56] References Cited

U.S. PATENT DOCUMENTS

| | | | |
|---|---|---|---|
| 1,527,299 | 2/1925 | Hacker | 83/698 X |
| 1,621,811 | 3/1927 | Richard et al. . | |
| 2,217,560 | 10/1940 | Michon | 164/118 |
| 2,382,267 | 8/1945 | Stellin | 164/118 |
| 3,245,694 | 4/1966 | Parker | 83/698 X |
| 4,096,776 | 6/1978 | Laucke | 83/698 |
| 4,174,648 | 11/1979 | Wallis | 83/698 |
| 4,339,976 | 7/1982 | Wallis | 83/698 X |
| 4,558,620 | 12/1985 | Wallis | 83/698 |
| 4,688,459 | 8/1987 | Osborn et al. | 83/698 |
| 4,726,270 | 2/1988 | Lucas | 83/698 X |
| 4,949,449 | 8/1990 | Wilson | 83/345 |
| 5,197,368 | 3/1993 | Meyer et al. | 83/698 |

*Primary Examiner*—Richard K. Seidel
*Assistant Examiner*—Kenneth E. Peterson
*Attorney, Agent, or Firm*—Biebel & French

[57] ABSTRACT

A retainer assembly and tool combination for holding and releasing the shank of a punch includes a triangular retainer body with a punch opening extending through the body. An elongated locking ball hole intersects the axis of the punch opening and a locking ball is movable in the hole to engage tear-drop shaped ball receiving recess formed on the shank of a punch. A generally rectangular ball release access slot is formed in the retainer body through one side wall of the retainer in intersecting relation with the ball receiving hole with its longer axis aligned parallel with the axis of the shank opening. A notch is formed in the wall of the ball hole in opposed relation to the access slot and forms a latching ledge. A ball release tool is proportioned to fit within the access slot and has a pointed end with a ball lifting tapered surface. The terminal end is undercut to form a latching surface which is proportioned to be received in resting relation on the notch ledge. The tool may be inserted within the retainer body for holding the ball elevated by the tool at a released hands-free position.

4 Claims, 4 Drawing Sheets

PUNCH RETAINER WITH PUNCH RELEASE TOOL

BACKGROUND OF THE INVENTION

This invention relates to punch retainers and release tools where the retainer is of the kind which employs a locking ball cooperating with a ball groove formed on the side wall of the shank of a punch, such as shown in U.S. Pat. No. 5,197,368 which issued Mar. 30, 1993, the disclosure of which is specifically incorporated herein by reference.

Metal punches are commonly retained in the body of a punch retainer by a diagonally movable locking ball. The locking ball is received in a diagonal ball hole and is spring biased into a seated position, in which a portion of the ball is partially received within a tapered ball groove or tear-drop shaped recess formed in the side wall of the shank of a punch. In removing the punch from the retainer, the locking ball is lifted out of its seated position against the bias of the spring, by a release tool. Formerly, a release tool had to be inserted through a small access opening in the lower face of the retainer body and an upward force on the release tool caused the ball to ride upwardly in its diagonal hole against a spring and out of locking engagement with the punch shank, thereby permitting the punch shank to be withdrawn.

In our patent '368, as identified above, embodiments are shown of arrangements by which a release tool may be inserted from a lateral position through an access slot in a side wall of the retainer. The access slot extends into the opening defined by the ball hole and a portion of the slot is below the lower circumference of the ball. The ball may be lifted by a tool from a seated position, by prying or by movement of the ball along a cam or inclined nose surface of the release tool.

Our patent '368 also describes the locking arrangement between the ball and the tear-drop shaped recess formed on a lateral side of the punch shank. The locking ball contacts the punch shank at two laterally spaced locations, while an opposite surface of the ball contacts the ball hole at a third location. In order to provide for access to the ball within the ball hole for lifting, it is important that the access slot be arranged and configured in such a manner that it does not intersect or interfere with either of the three ball contact locations.

Applicants' assignee, Dayton Progress Corporation, has for many years made and sold punch retainers of a unique and distinctive appearance in the form of a trilateral bodied retainer under the trademark True Position®, the shape of which is also registered as U.S. Trademark Reg. No. 1,507,804. This retainer body incorporates a particularly compact arrangement of punch shank recess, locking ball hole, retainer body mounting holes, and dowel pin locating bores. The True Position® retainer has a pair of transversely positioned bolt holes, and also has a pair of dowel pin locating bores in addition to the ball hole and the punch shank receiving bore.

The grouping and number of such holes and bores through the body preclude the use of a ball release access slot of the kind which extends through the retainer body from one lateral side to the other, as shown in FIGS. 7, 8 and 11 of our patent '368. There is accordingly, a need for a ball lifting and retaining mechanism for punch retainers having a trilateral shaped retainer body.

SUMMARY OF THE INVENTION

In the punch retainer of this invention, a locking ball is captured in, and moves within, a ball retaining hole, the axis of which is diagonal to the axis of the punch hole, such as 15° to the axis of the punch or the punch hole. The tear drop recess formed in the side of the shank of the punch is typically formed at 12° to the punch axis. Also, in the locking position, the ball does not ride to the bottom of the shank recess, but moves into a position in which it engages at triangulated positions by contact at the tear drop recess at two lateral positions equally spaced from a center line, and by contact at a third position at the diametrically opposite side of the ball, at the wall of the ball hole.

In the combination of the present invention, a ball release access slot extends from one side wall only of the retainer and into intersecting relation with the ball retention hole at a position where this intersection does not interfere with the critical ball contact or locking points as described above. In the case of the trilateral die punch retainer body, the side wall which permits such access is one of the walls which forms the apex including the punch recess, and is the wall opposite the side wall most closely adjacent to either of the dowel pin-receiving bores.

The access slot is generally vertically elongated in cross-section, such as rectangular or oval, and the vertical axial extends generally parallel to the axis of the punch shank bore. The access slot extends through the one side wall and opens into the ball hole in such a manner that a lower wall or ledge of the slot is positioned below the ball center when the ball is in its seated or locked position with the shank of a punch.

At a position in the ball hole itself, diametrically opposite the upper wall of the access slot there is provided a relief or a notch. This notch is formed with a width substantially equal to the width of the access slot but is formed with a limited or lesser height compared to the height of the slot and is, in effect, a blind hole, and is formed with a generally flat ledge or latching bottom, which is normal or orthogonal to the wall of the hole..

An improved ball release tool has the general form of an elongated bar with a tapered nose. The body of the release tool conforms generally to the access slot but is not quite as high as the slot, so that when inserted, it may be pivoted about the bottom wall of the slot with a limited vertical movement in the slot.

The terminal end of the nose of the tool is provided with a blunt forward sloping portion and an undercut latching surface or portion in the lower surface of the body. The terminal end of the nose, including the undercut latching surface, is proportioned to be received within the notch formed in the ball hole opposite the access slot, after the ball has been lifted or elevated by the tool to a raised and released position. A punch is released either by pushing the release tool directly into the slot, so that the tapered nose surface engages and lifts the ball against the spring in the ball hole, or the pointed end of the tool is inserted under the ball, and by pivoting or prying the tool about a pivot surface defined by the lower wall of the slot, the ball is lifted by the nose of the tool to a released position. In either case, the pried or tilted position of the tool permits the undercut latch surface on the tool to be received within the notch, so that the tool rests on the latching bottom of the notch in a hands-free position. In this position the tool is self-holding.

The arrangement of an undercut ball release tool and a blind notch, as described, is particularly useful when applied to the compact trilateral retainer bodies as previously described, since this modification does not interfere either with the ball contact points, as previously described, or with either the bolt-receiving holes or dowel pin bores. When it is desired to release the ball, the tool can simply be pulled to extract the latching interconnection between the point of the tool and the notch, and the ball will drop normally to a new seated position.

It is accordingly an object of this invention to provide a combination of a lateral tool access slot in a die body retainer which extends into the ball hole and is configured with a tool holding notch in an opposite wall of the ball hole in combination with a ball-lifting tool, whereby the lifting tool is self-holding in a particularly ball elevated position, which combination is useful for triangular bodied retainers.

A further object of the invention is the provision of a trilateral shaped punch retainer having a ball lifting tool access slot formed in one side wall thereof in non-interfering relation with locating openings in the retainer body and intersecting the locking ball hole at a position which does not interfere with the ball locking points, a latching notch formed in an opposed wall of the locking hole, and a ball-lifting tool having a latch portion which is configured to engage the latching notch so that the ball may be held in a released position in a hands-free condition.

These and other objects and advantages of the invention will be apparent from the following description, the accompanying drawings and the appended claims.

BRIEF DESCRIPTION OF ACCOMPANYING DRAWINGS

FIG. 4 is taken generally along the line 4—4 of FIG. 1;

FIG. 5 is taken generally along the line 5—5 of FIG. 1;

DESCRIPTION OF PREFERRED EMBODIMENT

Figure 2:
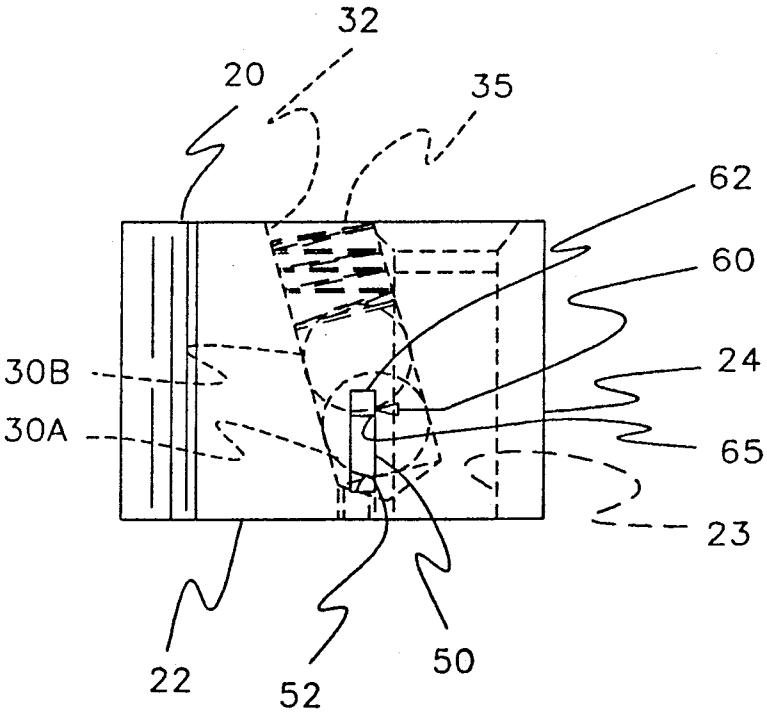
FIG. 2 is a side elevational view of the retainer of FIG. 1.
Figure 1:
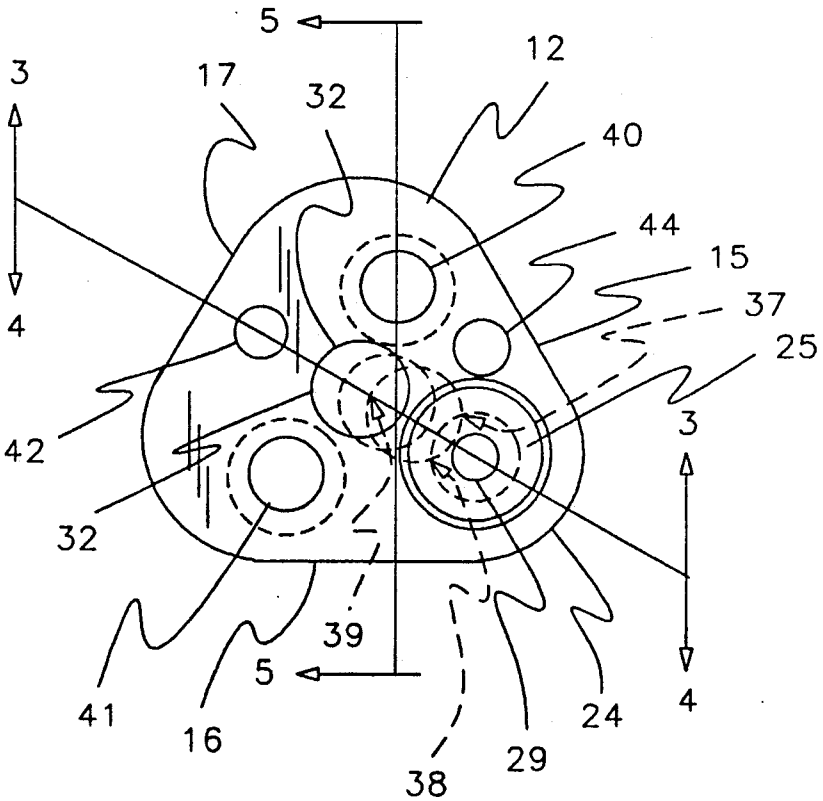
FIG. 1 is a top elevational view of a punch retainer in accordance with this invention.
Figure 4:
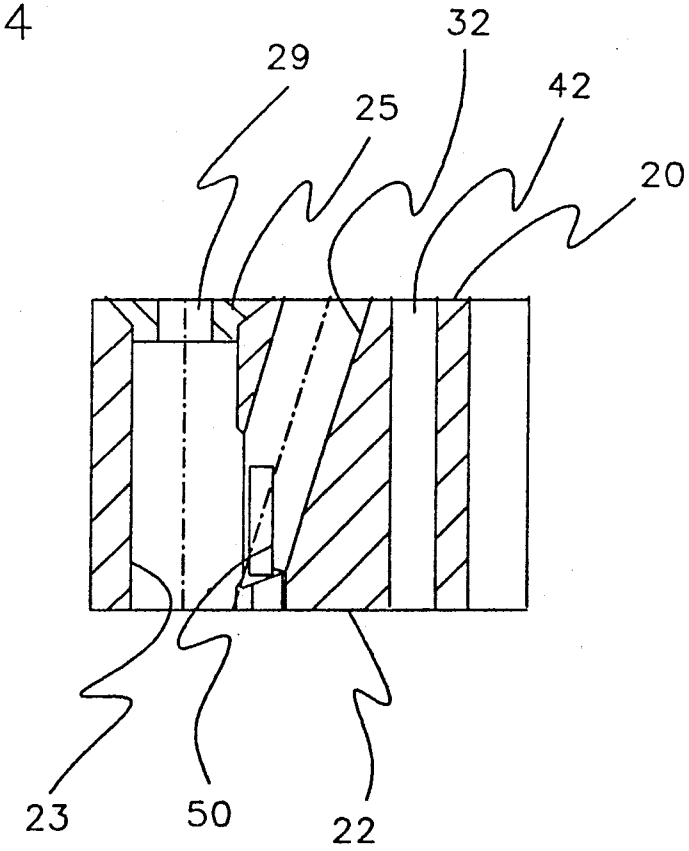
FIGS. 3–5 are sectional views through the retainer body simplified by the removal of the ball and spring, with FIG. 3 taken generally along line 3—3 of FIG. 1.
Figure 3:
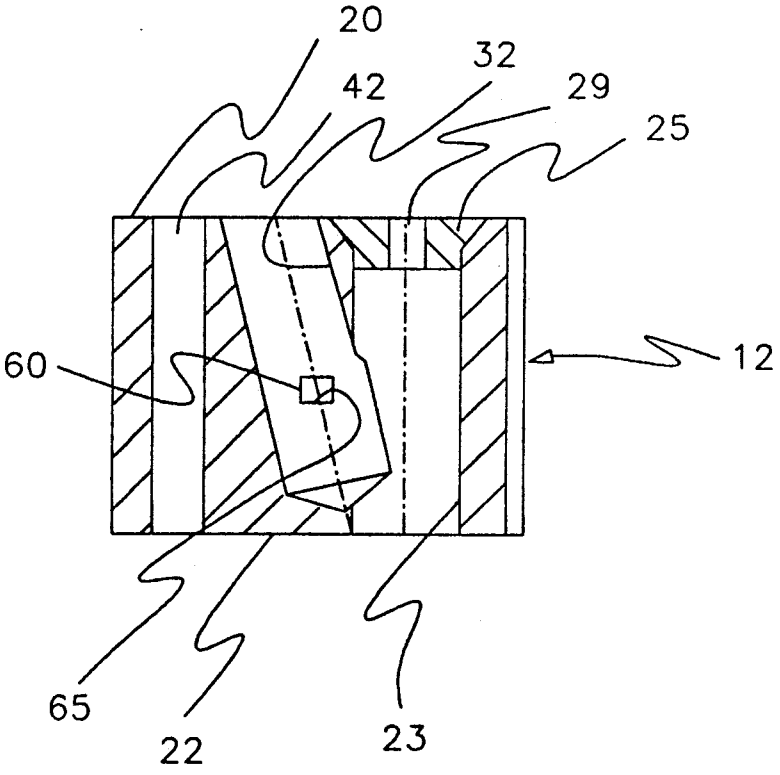
Figure 6:
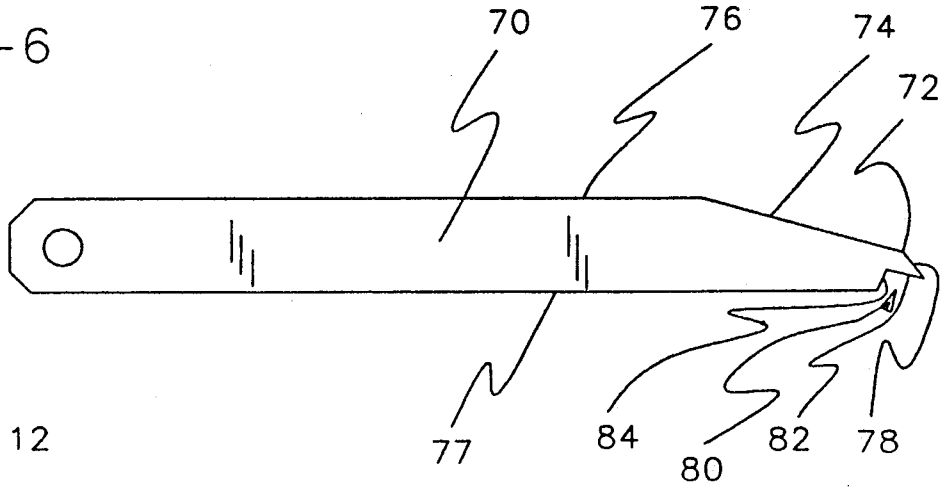
FIG. 6 is a side elevational view of a ball release tool according to this invention.
Figure 7:
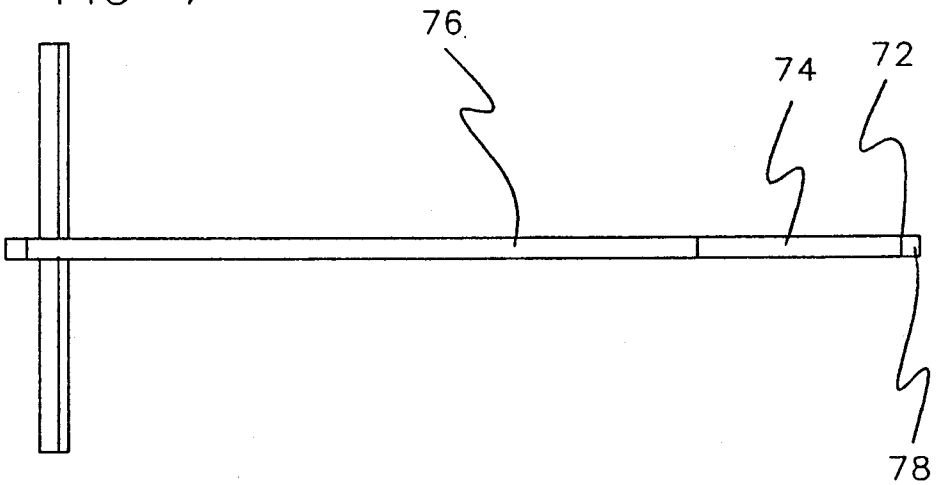
FIG. 7 is a top elevational view of the tool of FIG. 6.
Figure 5:
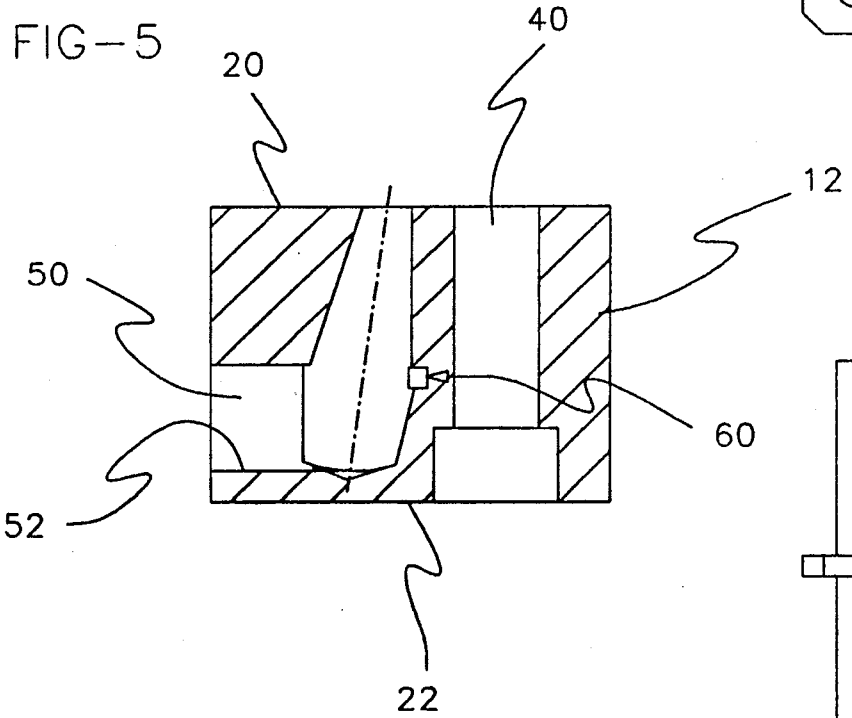

An improved retainer in accordance with a preferred embodiment of this invention is illustrated in FIGS. 1 and 2 as having a body 12 of a general trilateral configuration or geometry. For the purpose of this description, the body may be considered as having a pair of adjacent converging sides 15 and 16, and an opposed side 17. The retainer 12 includes a flat top or upper mounting surface 20 by which it may be mounted on a backing plate, or mounted directly to a die shoe. The retainer body 12 also has a flat bottom face 22, as shown in FIG. 2.

A punch opening 23 is formed in the body through the bottom face 22, adjacent the corner 24 defined between the converging sides 15 and 16. The upper end of the opening 23 may be closed by an impact insert 25, as described in U. S. Pat. No. 3,563,124. The center of the impact insert 25 forms a dowel pin locating opening 29, also as described in patent '124.

The retainer 12 is designed to retain the cylindrical shank of a punch (not shown) which extends into the interior of the retainer and abuts, at its upper end, against the impact insert 25, in the manner illustrated in patent '124. The shank of this punch is conventionally formed with a tear drop, ball-receiving recess, as shown in patent '124, and in patent '368.

A locking ball 30 is received in a diagonal ball hole 32 formed in the retainer body through the top surface 20. The hole is inclined at an angle to intersect the shank opening 23 above the face 22. The axis of the ball hole 32 may be inclined at approximately 15° to the axis of the shank opening 23 while the ball-locking recess conventionally formed on the tool shank, is typically at an angle of 12° to the axis.

The locking ball 30 forms a relatively close fit to the walls of the bore hole 32. The ball 30 may move between a lowered position in which it can come into locking engagement with the punch shank, as shown at position **30*a* in phantom in FIG. 2, and an elevated release position, as shown by the phantom position 30*b* in FIG. 2. The locking ball 30 is urged into its locking or lower position 30*a* by means of a compression coil spring 35 received between the upper surface of the ball 30 and the mounting surface 20**.

When the ball 30 is in its locking position, as explained in patent '368, it does not ride either to the bottom of the hole 32 or to the bottom of the tear-drop recess formed on the punch shank. Rather, it assumes an intermediate position. At this position, the ball contacts the punch at two equally spaced positions identified at 37 and 38 with respect to the punch recess and also contacts the wall of the hole 32 at a position generally opposite to that of the shank opening 23, identified at 39.

The punch body 12, as shown in FIG. 1, includes additional openings which extend through the body between the upper mounting surface 20 and the lower face surface 22. These openings include a pair of bolt-receiving mounting holes 40 and 41, and a dowel pin receiving bore 42 located on a direct line with the dowel pin locating hole 29 and the locking ball hole 23, and a laterally offset tertiary dowel pin locating bore 44. The bore 42 provides for accurate location of the body 12, such as by means of a "diamond" headed dowel pin. It is employed in those cases where a shaped punch is being used or otherwise where it is necessary to locate the retainer body 12 at two positions. A tertiary dowel bore 44 provides a third locating position for certain specialized applications.

The retainer body 12 is also formed with a vertically elongated ball release access slot 50. The shape of the slot 50 is not critical and it may be generally rectangular or oval in shape, with a height which exceeds its width for the purpose of accepting a tool as described in greater detail below.

The slot 50 extends into the interior of the body through the side wall 16 and terminates in intersecting relation to the ball-receiving hole 32 at a lateral side of the ball. The access slot 50 does not intersect or interfere with any of the other openings or recesses formed within the retainer. Also, the slot 50 intersects the ball hole 32 in non-interfering relation to the contact points 37, 38 and 39.

The vertical axis of the slot 50 is aligned generally parallel to the tool opening 23, and the bottom wall 52 of the slot 50 intersects the hole 32 in such a position between the center of the ball 30 and the lower or inner end of the ball hole 32 so that a tool inserted therein can engage the ball 30 from a position beneath the ball for lifting the ball against the spring 35. The lower wall 52 also forms a pry wall against which a ball-lifting tool may be leveraged, as described in patent '368.

A latching notch 60 is formed in the retainer body 12 in the wall of the ball hole 32 opposite the slot 50. The notch 60 is preferably formed by electro-discharge machining through the slot 50 and is in direct alignment with the axis of the slot 50. It has an upper wall 62 which may form a linear extension of the corresponding upper wall of the slot 50. The width of the notch 60 corresponds generally to the width of the slot 50, but the vertical extent of the notch 60 is substantially less than that of the slot 50 and thereby forms a bottom or lower latching ledge 65 accessible through the slot 50. The ledge 65 extends in generally normal or orthogonal relation to the wall of the ball hole.

The invention includes a specially configured ball release tool 70. The release tool 70 has a body in the form of an elongated bar. The body is proportioned to fit within the width of tool access slot 50, but is formed with a height less than the vertical height of the slot to permit pivotal movement of the tool in the slot.

The ball release tool 70 has a tapered nose 72 at one end which forms a ball-lifting cam surface 74. The cam surface 74 extends generally from the end of the bar to the upper surface 76 and in spaced relation to the lower or bottom surface 77. The nose of the bar is blunted at a surface 78 and defines, with the bottom surface 77, an undercut 80. The undercut 80 has a first upwardly inclined surface 82 extending from the surface 78 and a second downwardly inclined surface 84 extending to the bottom surface 77. The surface 82 is parallel with the cam surface 74 and defines a resting or latch surface which cooperates with the lower latching ledge 65 of the notch 60 for holding the tool 70 in a hands free position when the ball 30 is elevated by the tool 70 to a release position, out of engagement with a tool shank.

The angle of the sloping surface 74 may be about 20° to the bottom surface 77. Likewise, the notch 80 may be formed with a first surface 82 formed at the same 20° angle. Thus, the surface 82, at this angle, will rest flat on the latching ledge 65 of the notch 60, in the phantom position shown in FIG. 8.

The arrangement of the combination of the notched retainer and release tool of this invention provides the advantage of the through slot shown in patent '368 where, by reason of the construction of the retainer, it is not possible to extend the tool access slot through the retainer. This is particularly true with the triangular retainer, where it is not practical to extend a slot entirely transversely through the body of the retainer.

In the operation of the invention, the tool 70 may be inserted within the slot 50, with the nose or tip 72 under the ball 30 in the seated position of the ball. The tool 70 may then be simply rotated downwardly, as illustrated, by pivotal movement against the surface 52 to bring the nose 72 into alignment with the notch 60.

This rotating movement lifts the ball 30 within the ball hole out of its seated position. Alternatively, the tool 70 may be pressed inwardly to cause the ball 30 to ride up the cam surface 74 of the tool 70.

Figure 8:
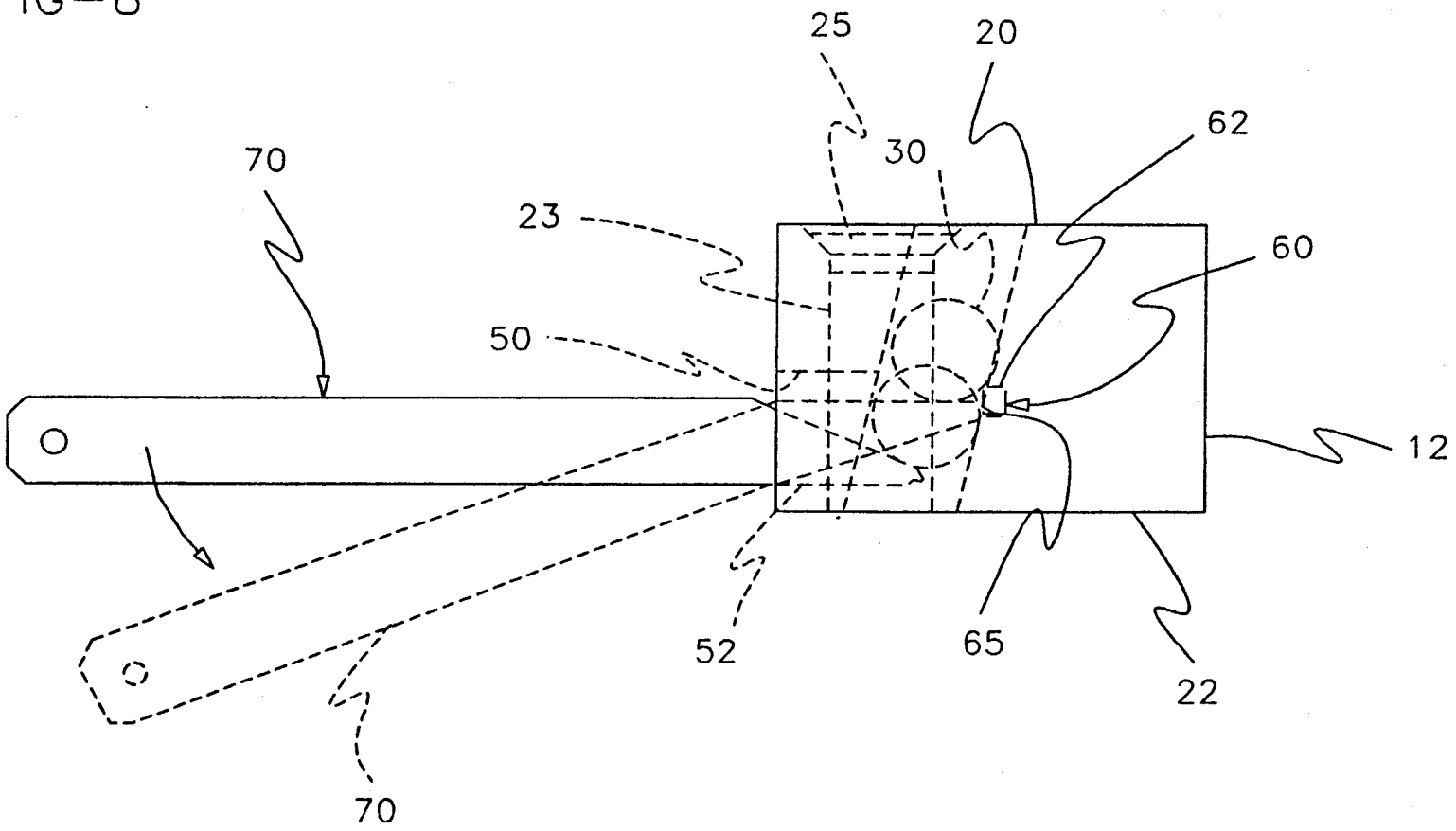
FIG. 8 is a diagram showing the manner in which the tool is inserted into the ball access slot for lifting the ball in either of two modes of operation, and further showing the manner in which the tool may be engaged with the latching notch so that the ball may be retained, hands free, in an elevated or released position.

After the tool is tilted to the position shown in the phantom view in FIG. 8, by rotation about the surface 52, the nose 72 may now be inserted into the notch 60 so that the surface 82 rests on the latching edge 65 of the notch 60. In this position, the tool 70 is self-holding and the ball is retained, hands free, in an elevated, released position. In this position, any punch may easily be removed or inserted through the punch opening 23. When it is desired to lock the punch in place, the tool 70 may be easily extracted, by pulling, from the opening 50, thereby allowing the ball 30 to be moved by the spring 35 into a locking position with a punch.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In an improved retainer assembly and tool for holding and releasing a shank of a punch, including a retainer body having a bottom, side walls, and a top mounting surface, a punch shank opening extending into the body through the bottom for receiving the shank of the punch, an elongated locking ball hole aligned on an axis which intersects an axis of the shank opening, a locking ball in the locking ball hole movable into locking position with a tear-drop shaped ball-receiving recess formed on the punch shank and a spring urging the ball into the locking position, in which said ball in its locking position engages said tear-drop recess at two angularly spaced contact positions on the shank of the punch and engages the retainer body at a third contact position, the improvement comprising:

a ball release access slot in said retainer body extending through one of said side walls and into intersecting relation with said ball hole, said access slot having a longer axis aligned generally parallel with the axis of said shank opening and terminating at said ball hole with a lower wall portion of the slot located between the ball in center when said ball in its said locking position, and said retainer bottom, means in said retainer body forming a notch in a wall of said ball hole positioned in opposed relation to said access slot and accessible through said slot, said notch having a lower latching ledge extending in generally normal relation to an adjacent portion of the wall of said hole, and, a ball release tool in the form of an elongated bar having an upper surface and a generally parallel lower surface and proportioned to fit within said access slot and having a nose on a terminal end in the form of a ball-lifting tapered surface extending generally from the terminal end of said bar in spaced relation to said lower surface, to said upper surface of said bar, said terminal end being undercut to form a latching surface proportioned to be received in resting relation on said notch latch ledge for retaining said tool hands free with said ball elevated by said tool to a released position out of engagement with the punch shank recess.

2. The retainer assembly and tool of claim 1 in which said tapered surface slopes at about 20° to said lower surface, and in which said latching surface extends generally parallel to said tapered surface.

3. The retainer assembly of claim 1 in which said ball release access slot is generally rectangular in cross-section and said release tool is also generally rectangular in cross-section and has a height less than that of the access slot to permit the ball release tool to be vertically pivoted within said slot.

4. In an improved retainer assembly and tool for holding and releasing a shank of a punch, including a generally triangular retainer body having a bottom, three side walls, and a flat top mounting surface, a punch shank opening extending into the body through the bottom for receiving the shank of the punch, an elongated locking ball hole aligned on an axis which intersects an axis of the punch shank opening, a locking ball in the locking ball hole movable into locking position with a tear-drop shaped ball-receiving recess formed on the punch shank and a spring urging the ball into the locking position, in which said ball in its locking position engages said tear-drop recess at two angularly spaced contact positions on the shank of the punch and engages the retainer body at a third contact position, and in which said body has a pair of transversely positioned mounting holes, a dowel pin receiving bore located on a line with said shank opening and said ball hole, and a tertiary dowel pin bore located in laterally offset position with respect to said line adjacent one of said side walls, the improvement comprising:

a ball release access slot in said retainer body extending through the side wall remote from said tertiary bore into intersecting relation with said ball hole, said access slot having a longer axis aligned generally parallel with the axis of said shank opening through said body, said access slot terminating at said ball hole with a lower wall portion of the slot located between the ball center when said ball is in its said locking position, and said retainer bottom, means in said retainer body forming a notch in a wall of said ball hole positioned in opposed relation to said access slot and accessible through said slot, said notch having a lower latching ledge extending in generally normal relation to an adjacent portion of the wall of said hole, and, a ball release tool in the form of an elongated bar having an upper surface and a generally parallel lower surface and proportioned to fit within said access slot and having a nose on a terminal end in the form of a ball-lifting tapered surface extending generally from said terminal end in spaced relation to said lower surface, to said upper surface of said bar, said bar terminal end being undercut to form a latching surface proportioned to be received in resting relation on said notch ledge for retaining said tool hands free with said ball elevated by said tool to a released position out of engagement with the punch shank recess.

* * * * *

UNITED STATES PATENT AND TRADEMARK OFFICE

CERTIFICATE OF CORRECTION

PATENT NO. : 5,307,720

DATED : May 3, 1994

INVENTOR(S) : David G. Meyer and Robert L. Shadowens

It is certified that error appears in the above-indentified patent and that said Letters Patent is hereby corrected as shown below:

Col. 6, line 46, delete "in" (first occurance); before "in" (second occurance) insert —is—.

Signed and Sealed this

Twenty-fifth Day of October, 1994

*Attest:*

*Attesting Officer*

Bruce Lehman

BRUCE LEHMAN

*Commissioner of Patents and Trademarks*